US005162697A

United States Patent [19]

Davis et al.

[11] Patent Number: 5,162,697

[45] Date of Patent: Nov. 10, 1992

[54] TRAVELING WAVE TUBE WITH GAIN FLATTENING SLOW WAVE STRUCTURE

[75] Inventors: Jon A. Davis; Ivo Tammaru, both of Rancho Palos Verdes, Calif.

[73] Assignee: Hughes Aircraft Company, Los Angeles, Calif.

[21] Appl. No.: 563,582

[22] Filed: Aug. 6, 1990

[51] Int. Cl.[5] ..... H01J 25/34

[52] U.S. Cl. ..... 315/3.6; 315/39.3

[58] Field of Search ..... 315/3.5, 3.6, 39.3, 315/39 TW; 333/156

[56] References Cited

U.S. PATENT DOCUMENTS

| | | | |
|---|---|---|---|
| 3,324,342 | 6/1967 | Eallonardo | 315/3.6 |
| 3,349,278 | 10/1967 | Huse, Jr. | 315/3.6 |
| 3,440,555 | 4/1969 | Woklstein | 315/3.5 X |
| 3,538,377 | 11/1970 | Slocum | 315/39.3 X |
| 3,716,745 | 2/1973 | Phillips | 315/3.5 X |
| 4,147,956 | 4/1979 | Horigome et al. | 315/3.5 X |
| 4,292,567 | 9/1981 | Fritchle et al. | 315/39.3 X |
| 4,315,194 | 2/1982 | Connolly | 315/3.5 X |
| 4,358,704 | 11/1982 | Conquest | 315/3.5 |
| 4,564,787 | 1/1986 | Kosmahl | 315/3.5 X |

FOREIGN PATENT DOCUMENTS

| | | | |
|---|---|---|---|
| 44-16090 | 7/1969 | Japan | 315/3.5 |
| 432825 | 9/1977 | U.S.S.R. | 315/3.5 |

*Primary Examiner*—Eugene R. Laroche
*Assistant Examiner*—Benny T. Lee
*Attorney, Agent, or Firm*—Jeannette M. Walder; Terje Gudmestad; W. K. Denson-Low

[57] ABSTRACT

A traveling wave tube (10) includes a coupled cavity type slow wave structure (100) having a driver stage (52) and an output section (101) with a primary section (64) and a velocity taper section (82) which in combinattion produce maximum signal gain at a predetermined frequency. A gain flattening section (104) is preferably disposed between the driver stage (52) and the primary section (64) of the output section (101), and is designed to operate at a reduced phase velocity selected to produce minimum or negative signal gain at approximately the predetermined frequency. The gain characteristics of the driver stage (52), gain flattening section (104), primary section (64), and velocity taper section (82) combine to produce minimum signal gain variation over an operating frequency range which spans the predetermined frequency, and expand the bandwidth of the traveling wave tube (10).

27 Claims, 5 Drawing Sheets

TRAVELING WAVE TUBE WITH GAIN FLATTENING SLOW WAVE STRUCTURE

BACKGROUND OF THE INVENTION

1. Field of the Invention

The present invention relates to a slow wave structure for a traveling wave tube which provides low variation in signal gain versus frequency and expanded bandwidth.

2. Description of the Related Art

In a traveling wave tube (TWT), a stream of electrons is caused to interact with a propagating electromagnetic signal or wave in a manner which amplifies the electromagnetic wave. In order to achieve such interaction, the electromagnetic wave is propagated through a slow wave structure, such as a conductive helix wound around the path of the electron stream, or a folded waveguide type of structure in which a waveguide is effectively wound back and forth across the path of the electron stream. For effective interaction, the slow wave structure is designed to propagate the electromagnetic wave with an axial phase velocity approximately equal to the velocity of the electron stream.

The main components of a conventional TWT are illustrated in FIG. 1. The TWT is generally designated as 10, and includes an electron gun 12 which generates and feeds the electron stream into a slow wave structure 14. The electron stream is guided through the slow wave structure by means of a static magnetic focusing field and is captured at the other end of the slow wave structure 14 by an electron collector unit 16. The electromagnetic wave is fed into the slow wave structure 14 through a radio frequency input coupler 18, and led out of the structure 14 through a radio frequency output coupler 20.

The slow wave structure 14 provides a path for propagation of the electromagnetic wave which is considerably longer than the axial length of the structure 14, whereby the electromagnetic wave is made to propagate through the slow wave structure 14 at a phase velocity which is approximately equal to the propagation velocity of the electron stream. The interactions between the electrons in the stream and the traveling wave cause velocity modulation and bunching of electrons in the stream. The net result is a transfer of energy from the electron stream to the electromagnetic wave traveling through the slow wave structure 14, and exponential amplification of the traveling wave.

TWTs are highly useful for amplification of signals at microwave, and more recently, millimeter wave frequencies, for communications, radar, and numerous other applications. The present invention especially relates to a TWT which employs a folded waveguide type slow wave structure including a plurality of coupled cavities, such as disclosed in U.S. Pat. No. 3,010,047, entitled "TRAVELING-WAVE TUBE", issued Nov. 21, 1961, to D. Bates.

The electron stream slows down in velocity as it gives up energy to the traveling wave. As a result, the traveling wave and the electron stream progressively lose synchronization, with the electron stream lagging behind the traveling wave. Eventually, the electron bunches are no longer favorably phased to give up energy to the traveling wave, and the amplification process ceases. Further amplification may be obtained by providing the slow wave structure 14 with a "velocity taper" section which progressively slows down the traveling wave to match the reduction in axial velocity of the electron stream.

FIG. 2 illustrates the slow wave structure 14 as being of the coupled cavity type, including a driver stage 22 and an output section 24. The driver stage 22 is subdivided into an input section 26 and a center section 28 by a sever section 30. The sever section 30 is provided to prevent the generation of reflected waves which could result in oscillation, and typically includes a high loss material which absorbs substantially all of the traveling wave while enabling the velocity modulated electron stream to pass therethrough unaffected. The electron stream entering the center section 30 generates a new traveling wave, which itself interacts with the electron stream to produce more signal gain.

Another sever section 32 which provides the same function as the sever section 30 is disposed between the driver stage 22 and the output section 24. The output section 24 typically includes a primary section 34, which operates at substantially the same phase velocity as the driver stage 22, to overcome losses introduced by the severs 30 and 32 and provide a strong input signal for a velocity taper section 36. The section 36 is designed to operate at a reduced phase velocity and may include several subsections (not shown) to match the phase velocity reduction of the traveling wave to the axial velocity reduction of the electron stream.

The sections 26, 28, 34 and 36 have essentially similar configurations. FIG. 3 illustrates a representative portion of any one of these sections which includes a plurality of hollow spacers 38 alternating with discs 40. The discs 40 separated by the hollow spacers 38 define cavities 42 therebetween, and have arcuate slots 44 formed therethrough for coupling adjacent cavities 42 together. The discs 40 further have a central hole 45 for passage of the electron stream and may be formed with central drift tubes 46 on either side. The drift tubes 46 enhance the interaction between the electromagnetic wave and the electron stream.

With reference also being to FIG. 4, the discs 40 are assembled in an alternating manner such that the slots 44 of adjacent discs 40 are inverted by 180° relative to each other. The resulting configuration constitutes a folded waveguide, having an effective length greater than the axial length of the structure 14. The phase velocity in the slow wave structure 14 may be reduced by reducing the spacing between adjacent discs 40, and vice-versa. Although not shown, the structure 14 is further provided with suitable means for confining the electron stream within the central axial hole 45, such as a periodicpermanent-magnet (PPM) arrangement as disclosed in the above referenced patent to Bates.

A traveling wave tube of conventional design has a small signal gain characteristic curve which decreases parabolically from a maximum value at a particular frequency. The signal gain variation is generally quite large, and is especially undesirable in millimeter-wave TWTs where the performance band is a small fraction of the total cold passband due to weak interaction between the traveling wave and electron stream. The cold passband is the frequency range between the lower and upper cavity mode cutoff frequencies of the TWT. The large signal gain variation and associated narrow performance band cause high bit error rates in TWTs used in communication systems as described in an article entitled "Bit-Error-Rate Testing of High-Power 30-GHz Traveling-Wave Tubes for Ground-Terminal Applications", by K, Shalkhauser, in IEEE TRANSACTIONS ON ELECTRON DEVICES, Vol. ED-34, No. 12, December 1987, pp. 2625–2633.

Although it is theoretically possible to flatten the signal gain variation using gain equalizers, these are expensive, time consuming to use, not readily available at millimeter-wave frequencies, and often introduce phase distortion.

SUMMARY OF THE INVENTION

The present invention reduces the parabolic signal gain variation in a TWT, and also expands the bandwidth. A slow wave structure has minimum, preferably negative, gain in a region which is higher in frequency than the normal positive gain frequency range. By making the phase velocity in a section of the structure slower than the standard value in the main part of the structure, the slower section will have its gain versus frequency characteristic curve shifted lower in frequency relative to the main part. In accordance with the principle of the invention, the frequency of maximum attenuation (minimum or negative gain) of the slower section is designed to correspond to the frequency of the main part of the structure at which the gain is maximum, thereby flattening the overall gain and increasing the effective bandwidth.

The present invention exploits the negative gain region which occurs just above the normal positive gain frequency band in a TWT. In this region, the energy of the traveling wave is transferred to the electron stream. If the phase velocity of the traveling wave is reduced, as in a velocity taper, the gain bands are shifted lower in frequency. A TWT embodying the invention includes both standard and reduced phase velocity sections, centering the negative gain region of the slower phase velocity section at the maximum gain region of the standard section, thereby flattening the overall gain curve.

The slow phase velocity section may be disposed at the beginning of the outputs section for gain flatness. A conventional velocity taper is also provided at the end of the output section to optimize the efficiency in the normal manner. It has been determined that the small signal performance of the present invention extends into the large signal region, enabling the present TWT to operate effectively over a large range of signal power.

A traveling wave tube embodying the present invention includes a coupled cavity type slow wave structure having a driver stage and an output section with a primary section and a velocity taper section which in combination produce maximum signal gain at a predetermined frequency. A gain flattening section is preferably disposed between the driver and velocity taper sections, and is designed to operate at a low phase velocity selected to produce minimum signal gain at approximately the predetermined frequency. The gain characteristics of the driver stage, and gain flattening, primary, and velocity taper sections of the output section combine to produce minimum signal gain variation over an operating frequency range which spans the predetermined frequency, and expand the bandwidth of the device. The gain flattening section may alternatively be provided in the driver stage.

The present invention provides a TWT with reduced gain and phase variations, enabling substantially improved performance including lower bit error rates in communication systems.

These and other features and advantages of the present invention will be apparent to those skilled in the art from the following detailed description, taken together with the,, accompanying drawings, in which like reference numerals refer to like parts.

DETAILED DESCRIPTION OF THE INVENTION

The numerical values in the following description refer to a computer generated simulation for a TWT including a coupled cavity type slow wave structure 50 illustrated in FIG. 5 of the type described with reference to FIGS. 1 to 4. The TWT is assumed to have the following specifications, which are not to be construed as limitative of the scope of the invention.

Frequency band—43.5 to 45.5 GHz; Saturated Output Power—150 watts; Duty cycle—CW; RF Input Power—0.5 dBm; Cathode Voltage—−18.8 KV; Cathode Current—85.5 mA; Body Voltage—ground; RF Body Current—4.2 mA; Collector Voltage—−11.5 KV; Modulation—Anode; Cooling—Forced Air; Focusing—Periodic Permanent Magnets; Length—46 cm; Diameter—10 cm; Weight—5.4 kg.

Figure 1:
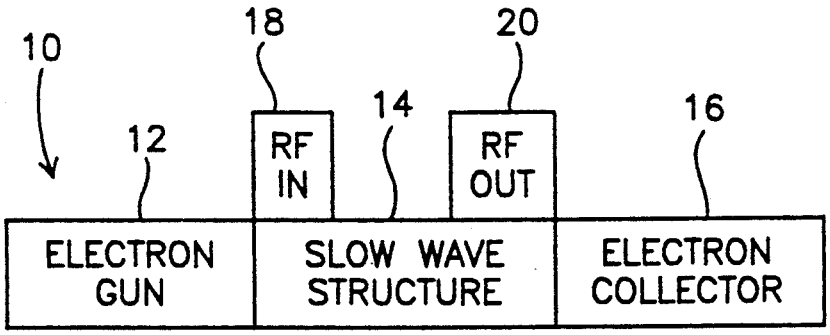
Fig.1 (Prior Art)
FIG. 1 is a block diagram illustrating the main components of a conventional TWT.
Figure 2:
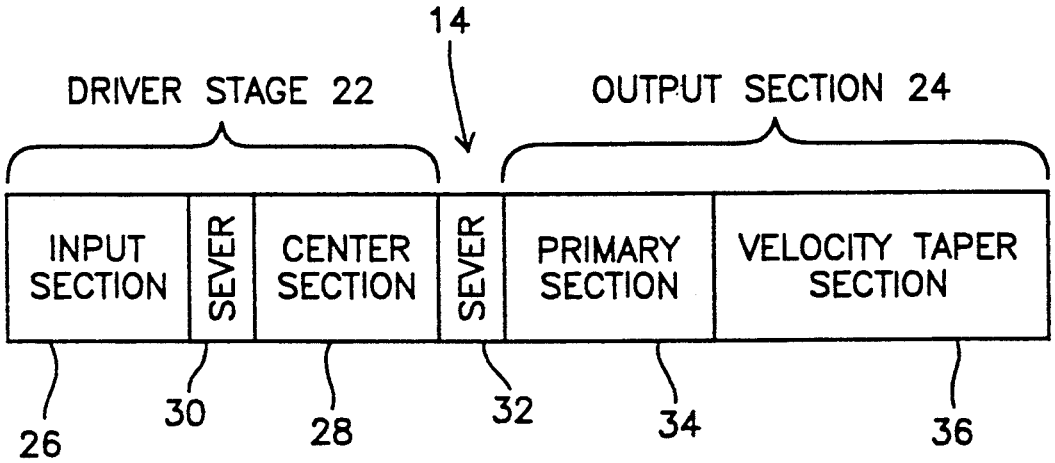
Fig.2 (Prior Art)
FIG. 2 is a block diagram illustrating the configuration of a slow wave structure of the TWT shown in FIG. 1.
Figure 3:
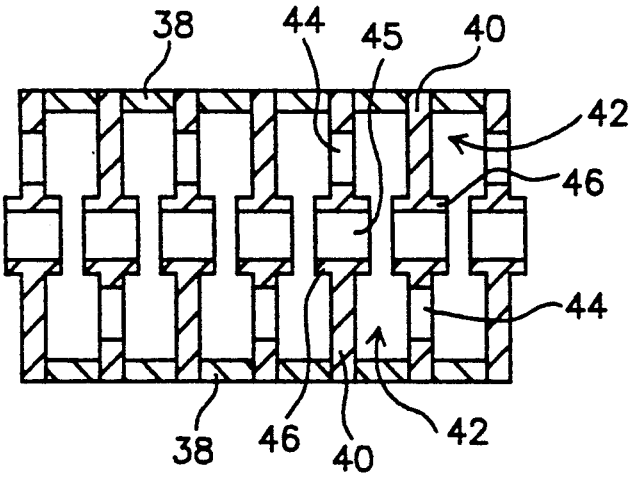
Fig.3 (Prior Art)
FIG. 3 is a longitudinal section illustrating an arrangement of coupled cavities in the slow wave structure shown in FIG. 2.
Figure 4:
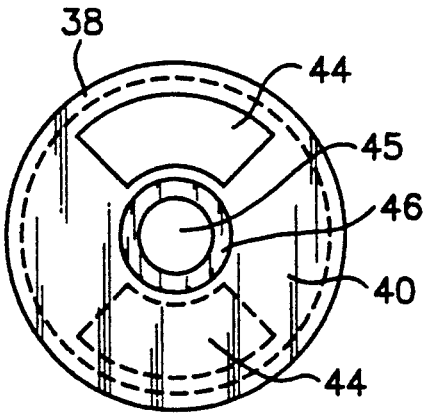
Fig.4 (Prior Art)
FIG. 4 is an end view of the section in FIG. 3 illustrating the configuration of the discs and spacers.
Figure 5:
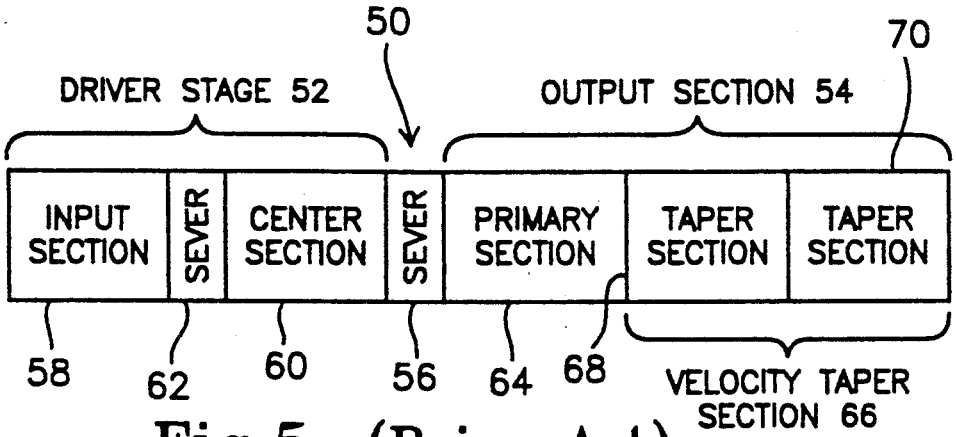
Fig.5 (Prior Art)
FIG. 5 is a block diagram illustrating the configuration of a conventional slow wave structure prior to modification thereof in accordance with the present invention.

Referring now to FIG. 5, the slow wave structure 50 includes a driver stage 52, and an output section 54 which is disposed downstream of the driver stage 52 and separated therefrom by a sever section 56. The driver stage 52 includes an input section 58 and a center section 60 separated by a sever section 62. The spacing between the discs 40 which determine the lengths of the cavities 42 in the driver stage 52 are designed to cause the traveling wave to propagate through the structure 50 at a predetermined standard phase velocity which is approximately equal to the axial velocity of the electron stream propagating through the structure 50. The standard phase velocity is defined as 100%. The input section 58 includes 55 standard phase velocity cavities 42, whereas the center section 60 includes 50 standard cavities.

The output section 54 includes a primary section 64 having 64 standard cavities, and a velocity taper section 66. The section 66 includes a section 68 having 18 cavities which operate at a phase velocity which is 95% of the standard value, and a section 70 disposed downstream of the section 68 including 17 cavities which operate with 90% phase velocity. The velocity taper section 66 is designed to maximize the efficiency of the slow wave structure 50 in a conventional manner. All of the cavities 42 have approximately the same cold pass band, with electrical periods proportional to their phase velocities.

Figure 6:
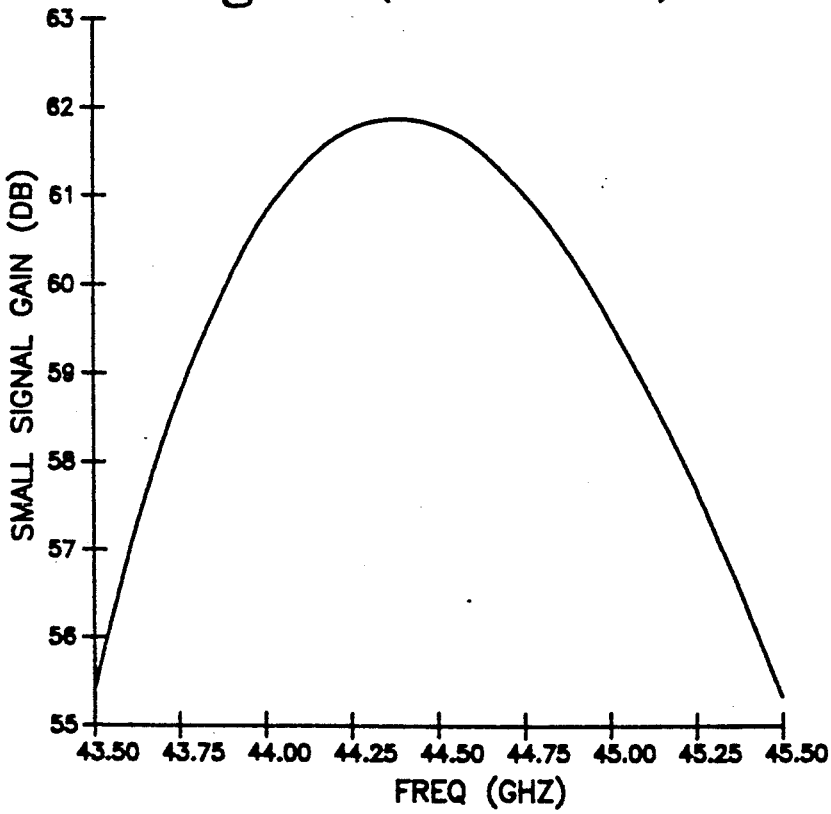
Fig.6 (Prior Art)
FIG. 6 is a graph illustrating the small signal gain characteristic of the slow wave structure shown in FIG. 5 as a function of frequency.

The performance of the slow wave structure 50 is illustrated in FIG. 6. The small signal gain varies parabolically over a large range of 6.5 dB within an operating frequency band of 43.5 to 45.5 GHZ. The signal gain has a maximum value at approximately 44.375 GHZ.

Figure 7:
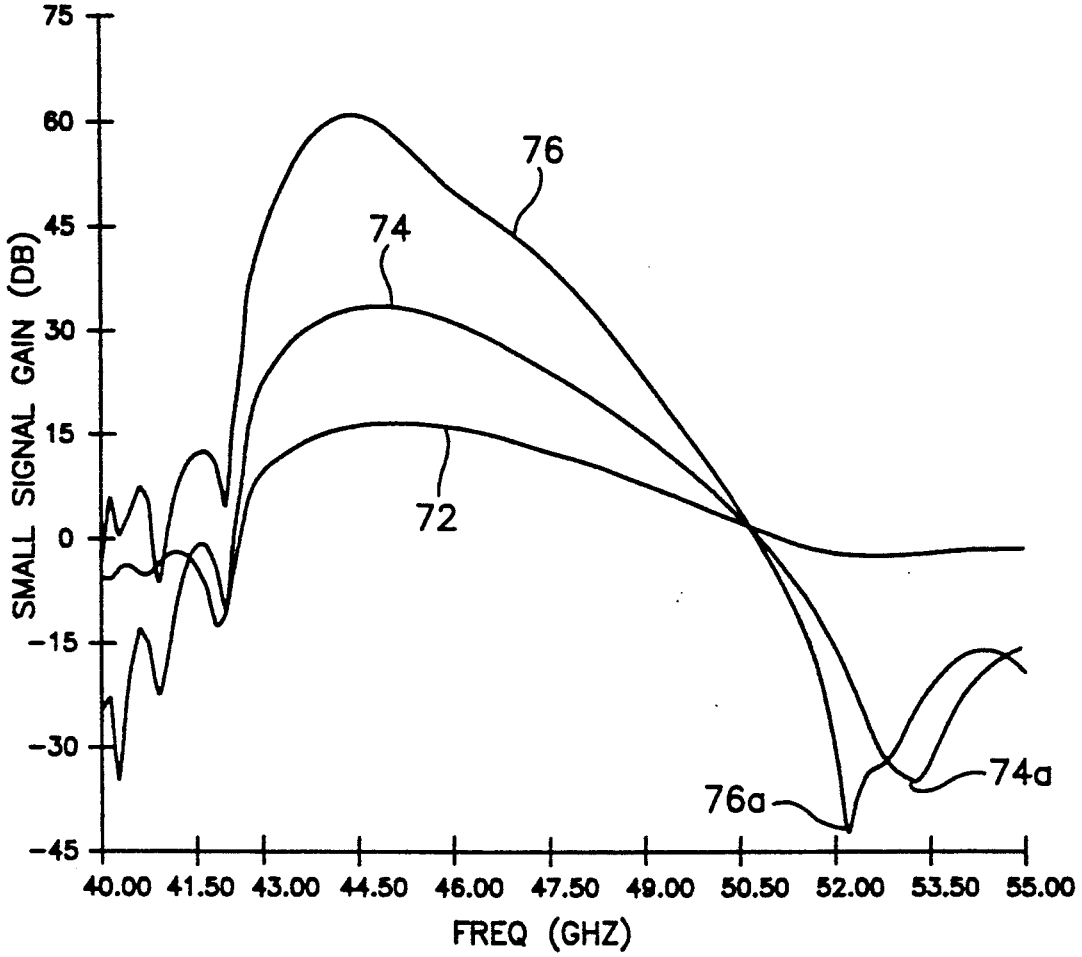
Fig.7 (Prior Art)
FIG. 7 is a graph illustrating the small signal gain characteristics for individual sections of the slow wave structure shown in FIG. 5.

The small signal gain characteristics for various sections of the structure 50 are illustrated in FIG. 7. A curve 72 illustrates the signal gain characteristic of the input section 58. Curves 74 and 76 illustrate the gain characteristics at the end of the center section 60 and at the end of the output section 54 respectively. It will be noted that the curves 74 and 76 have negative gain or notch regions with minimum values designated as 74*a* and 76*a* respectively.

Figure 8:
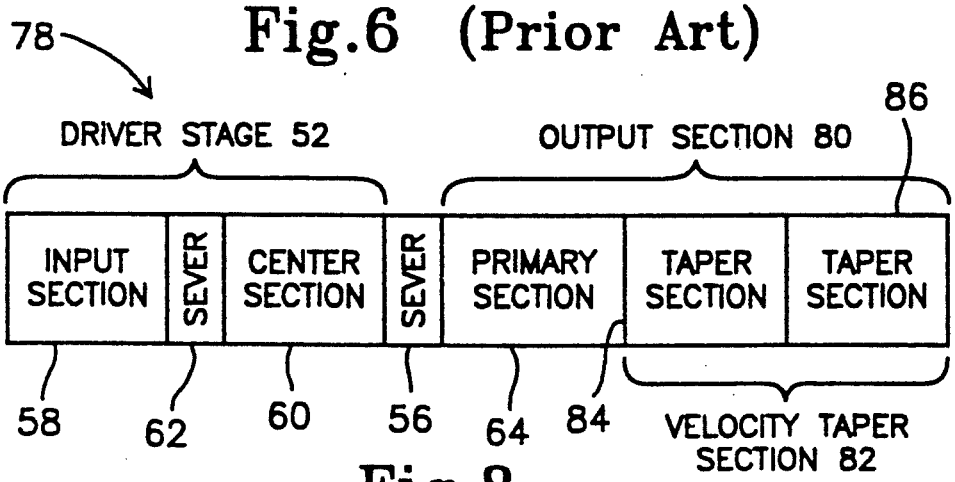
FIG. 8 is a block diagram illustrating the configuration of the slow wave structure shown in FIG. 5 as having an output section modified to minimize the small signal gain variation.

FIG. 8 illustrates the result of modifying the configuration of the output section 54 of the slow wave structure 50 to minimize the small signal gain variation, rather than to maximize the efficiency as in the conventional design, with like elements designated by the same reference numerals. This expedient produces the minimum small signal gain variation which is attainable through modification of the conventional configuration, and may be employed in combination with the improvement of the present invention as will be described below. A slow wave structure 78 includes a modified output section 80, having the same primary section 64 as in the slow wave structure 50. The velocity taper section has been modified and is designated as 82. The section 82 includes a section 84 having 22 cavities at 95% phase velocity, and a section 86 having 8 cavities at 90% phase velocity.

Figure 9:
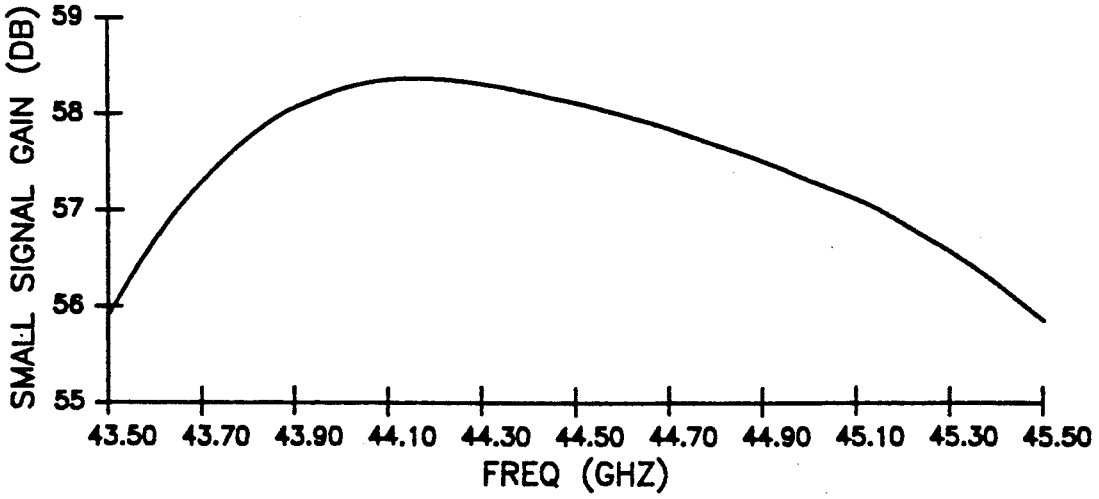
FIG. 9 is a graph illustrating the small signal gain characteristic of the slow wave structure shown in FIG. 8 as a function of frequency.

The modified velocity taper section 82 reduces the variation in small signal gain as illustrated in FIG. 9. The parabolic small signal gain variation is reduced from 6.5 dB as in the case of the conventional design to 2.4 dB. In all of these exemplary cases, the beam current and beam diameter were maintained constant, and the cathode voltage was adjusted to balance the gain at the band edges. An alternative method to achieve the same small signal gain at the edges of the desired performance band is to make minor adjustments in the phase velocity in one or another of the sections with nominally standard cavities (i.e., the input, center, and primary sections).

Figure 10:
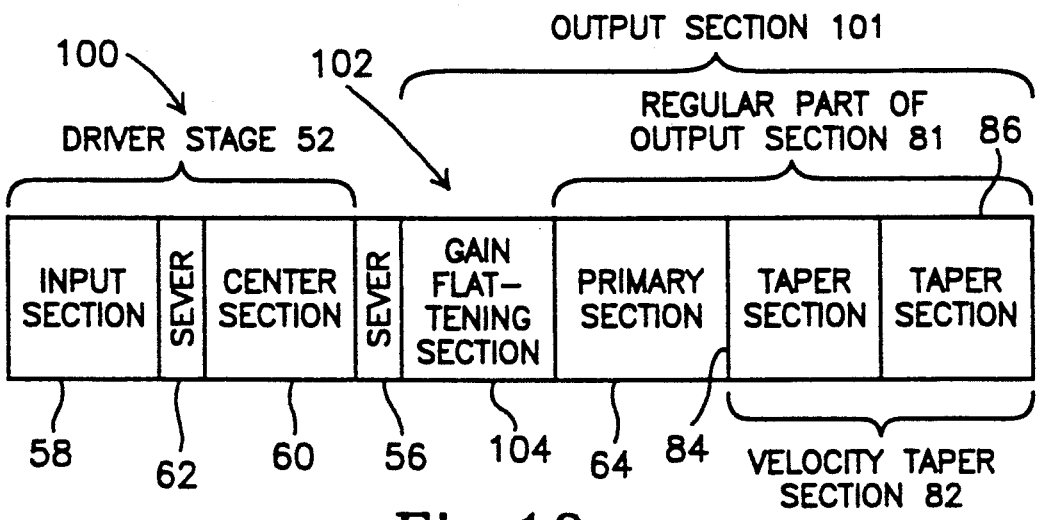
FIG. 10 is a block diagram illustrating the configuration of the slow wave structure shown in FIG. 8 modified in accordance with the present invention to include a gain flattening section which further minimizes the small signal gain variation.

A slow wave structure embodying the present invention is illustrated in FIG. 10 and generally designated as 100. The structure 100 includes a main section 102 consisting of the driver stage 52 and a regular part 81 of an output section 101, wherein the regular part 81 has the same configuration as the entire output section 80 in the slow wave structure shown in FIG. 8. Specifically, the velocity taper section 82 of the main section 102 is designed to minimize the variation in signal gain as described above.

In accordance with the present invention, the slow wave structure 100 further includes a gain flattening section 104 disposed downstream of the driver stage 52, with the regular part 81 of the output section 101 disposed downstream of the gain flattening section 104. In the exemplary computer generated design, the section 104 has 33 cavities having 90% phase velocity.

Figure 11:
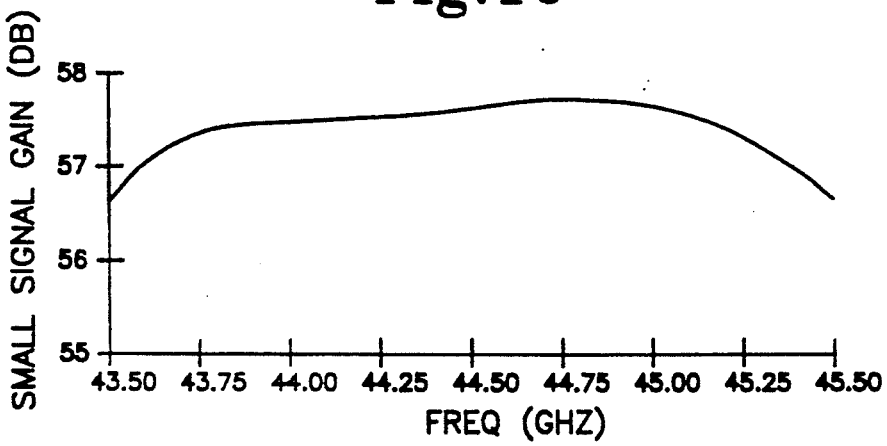
FIG. 11 is a graph illustrating the small signal gain characteristic of the slow wave structure shown in FIG. 10 as a function of frequency.

The performance of the slow wave structure 100 is illustrated in FIG. 11. The signal gain variation has been reduced to approximately 1 dB, approaching the theoretical goal of constant signal gain or zero variation over the performance frequency range. The calculated phase deviation from linear is reduced by a factor of two over the conventional design illustrated in FIG. 5.

The principle of the present invention is to combine a gain flattening section having a minimum, preferably negative gain or attenuation region such as illustrated at 74*a* or 76*a* in FIG. 7, with the main portion of a slow wave structure, such that the minimum gain frequency of the gain flattening section corresponds to the maximum gain frequency of the main portion. The maximum and minimum gain effects operate in combination such that the gain curve is flattened out and broadbanded as illustrated in FIG. 11. Although only the design frequency range of 43.5 to 45.5 GHZ is plotted in FIG. 11, the slope of the curve at the band edges is much smaller than for the conventional design shown in FIG. 6, illustrating that the usable performance band extends significantly beyond the design frequency range.

The minimum gain region above the positive gain region in the signal gain characteristic curve is the key to the present invention. Although the minimum gain region has been described and illustrated as having negative gain or attenuation, it is within the scope of the invention to provide the gain flattening section as having low, but not negative gain, at the maximum gain frequency of the main portion of the slow wave structure. The reduced phase velocity cavities that contribute to the attenuation should be combined with cavities of substantially standard phase velocity in the same section. In this regard, the gain flattening portion of the present slow wave structure 100 may be considered as including the gain flattening section 104 in combination with the primary section 64.

Figure 12:
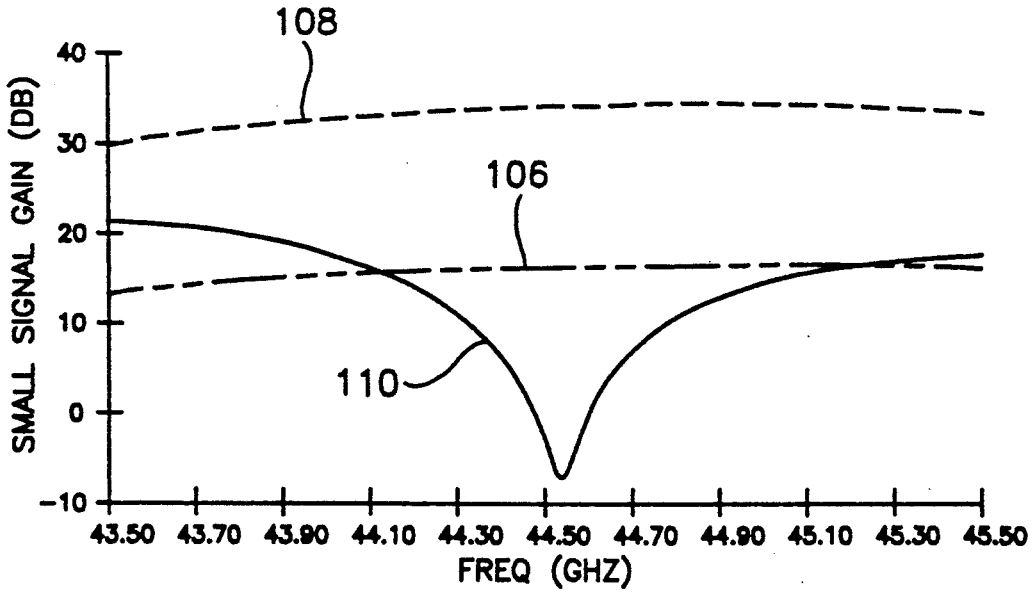
FIG. 12 is a graph illustrating the small signal gain characteristics for individual sections of the slow wave structure shown in FIG. 11.

FIG. 12 illustrates the small signal gain characteristics of individual sections of the slow wave structure 100. A curve 106 illustrates the gain at the output of the input section 58, a curve 108 illustrates the gain at the output of the center section 60, and a curve 110 illustrates the gain at the end of the gain flattening section 104. The various cavity sections interact with each other in a complicated manner, rather than simple algebraic combination of the gain characteristics thereof. For this reason, the minimum gain frequency of the gain flattening section 104 may in actual practice approximate, but not correspond exactly, to the maximum gain frequency of the main portion of the slow wave structure. Whereas the maximum gain of the main portion of the structure as illustrated in FIG. 6 is 44.375 GHZ, the minimum frequency of the gain flattening section as computed to produce minimum overall signal variation is slightly different, at about 44.55 MHZ.

The actual design of the slow wave structure may be done empirically, or more preferably using an iterative computer program. In the exemplary illustrated design, the gain flattening section 104 consisting of 33 cavities at 90% phase velocity provided just the right amount of signal gain loss in the minimum gain or notch region near the band center. If more 90% cavities were used, the notch would move lower in frequency and produce more overall attenuation, resulting in reduced gain performance. If a less severe taper was used, such as 95%, more cavities would have to be provided to move the notch to the desired frequency, again resulting in more overall attenuation. In the latter case, the overall gain curve would have a notch in it, and the signal gain would not be flat as desired.

Although a preferred location for the gain flattening section 104 is at the beginning of the output section 101 as described above with reference to FIG. 10, the invention is not so limited, and the gain flattening section may be provided at any location in the traveling wave tube at which it can be configured to provide its intended function. FIGS. 13 to 16 illustrate alternative embodiments of the invention in which the gain flattening section is provided in the driver stage, rather than in the output section. The output section has the same configuration as in FIG. 8, and is similarly designated as 80.

Figure 13:
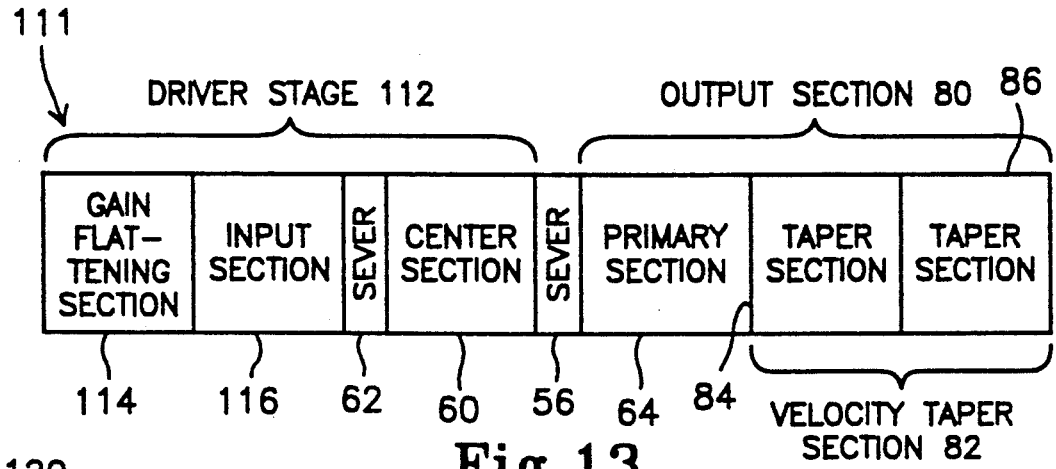
FIGS. 13 to 16 are block diagrams illustrating alternative locations of the gain flattening section in the driver stage.

In FIG. 13, a slow wave structure 111 includes a driver stage 112 having the center section 60 as previously described. However, the input section is designated as 116, and a gain flattening section 114 is disposed at the beginning or upstream end of the input section 116. The input section 116 may be the same as the input section 58 of FIG. 10, or it may be modified to accommodate the phase velocity change introduced by the gain flattening section 114.

Figure 14:
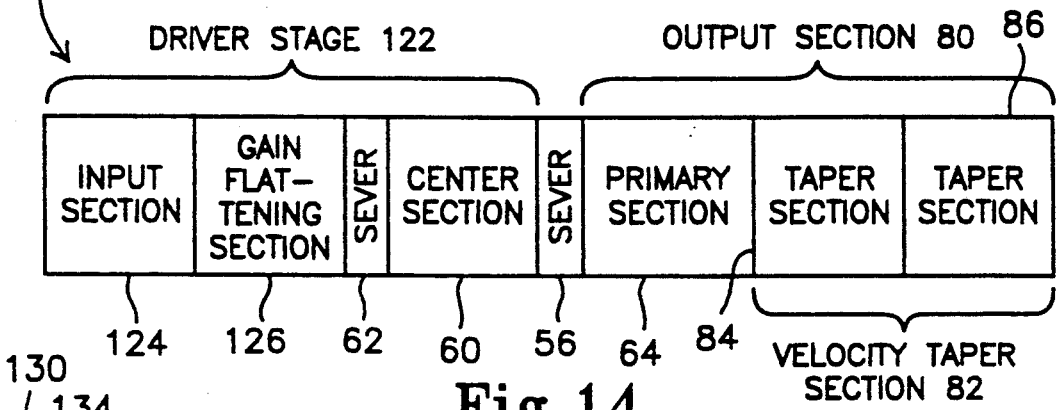

In FIG. 14, a slow wave structure 120 is similar to the structure of FIG. 13, but includes a driver stage 122 having a gain flattening section 126 disposed at the downstream end of an input section 124.

Figure 15:
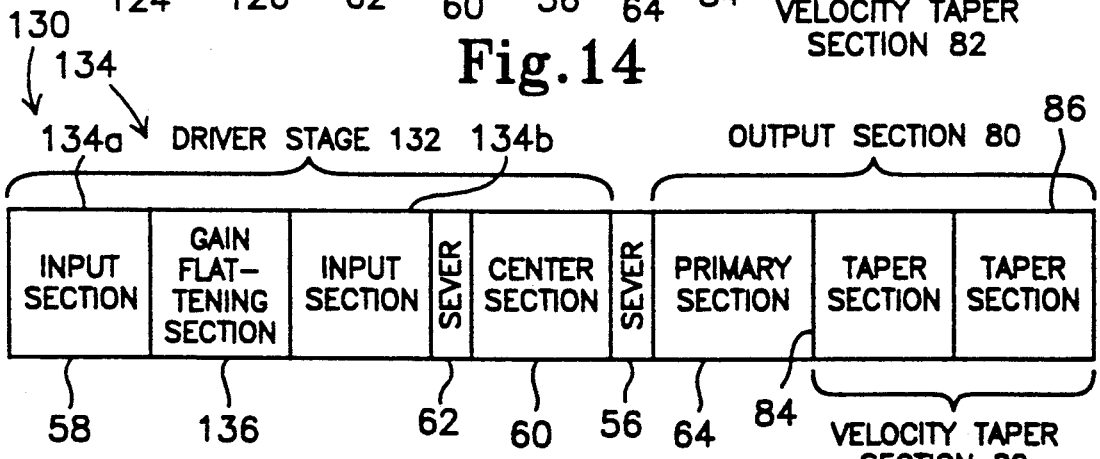

In FIG. 15, a slow wave structure 130 is also similar to the structure of FIG. 13, but includes a driver stage 132 having a gain flattening section 136 disposed at an intermediate location between sections 134*a* and 134*b* of an input section 134. In this embodiment, the gain flattening section 136 may have fewer cavities than the gain flattening sections 114 and 126, but the tapers will be more severe, typically below 95%.

Figure 16:
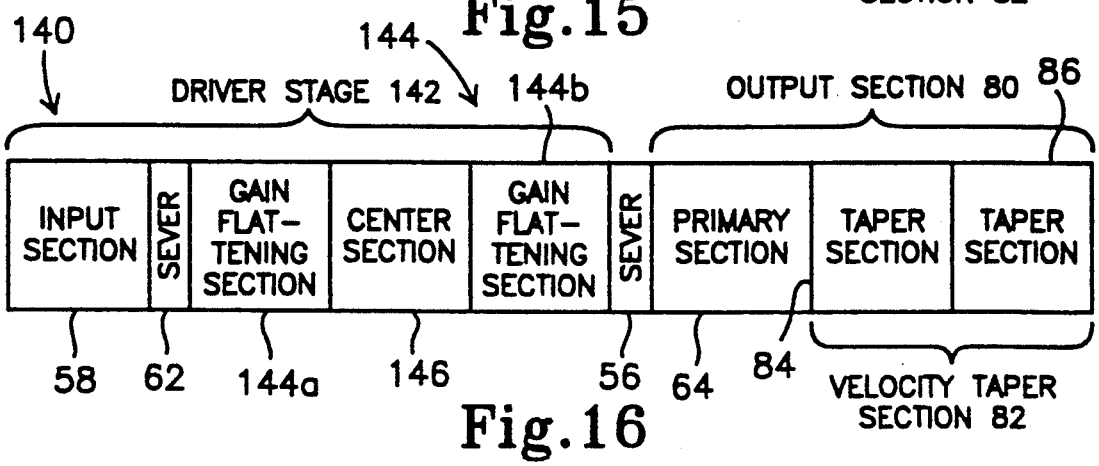

It is further within the scope of the present invention to provide a slow wave structure including more than one gain flattening section. FIG. 16 illustrates a slow wave structure 140 embodying the present invention including a driver stage 142 which incorporates the input section 58. In this case, two gain gain flattening sections 144*a* and 144*b* are disposed at the opposite ends of a center section 146

While several illustrative embodiments of the invention have been shown and described, numerous variations and alternate embodiments will occur to those skilled in the art, without departing from the spirit and scope of the invention. Accordingly, it is intended that the present invention not be limited solely to the specifically described illustrative embodiments. Various modifications are contemplated and can be made without departing from the spirit and scope of the invention as defined by the appended claims.

We claim:

1. In a traveling wave tube, a slow wave structure for causing interaction between an electron beam generated by an electron beam generating means and an electromagnetic signal generated by an electromagnetic signal generating means propagating therethrough and thus providing gain to the electromagnetic signal through said interaction with the electron beam, comprising:

a main signal interaction section which causes the electromagnetic signal to propagate therethrough with a predetermined first phase velocity and interact with the electron beam to produce maximum signal gain at a predetermined frequency within a predetermined frequency range; and a gain flattening signal interaction section which is aligned with said main section in a direction of propagation of the electron beam through the slow wave structure and causes the electromagnetic signal to propagate therethrough with a predetermined second phase velocity which is lower than the first phase velocity and interact with the electron beam to produce a minimum signal gain notch region at approximately said predetermined frequency within said predetermined frequency range;

said main and gain flattening sections being coupled together to cause interaction between the electron beam and the electromagnetic signal such that an output signal gain of the slow wave structure over said predetermined frequency range is generally constant.

2. A traveling wave tube as in claim 1, in which said main and gain flattening sections each comprise a plurality of coupled signal interaction cavities which are aligned with each other in said direction of propagation.

3. A traveling wave tube as in claim 1, in which said main section comprises a driver signal interaction stage, said gain flattening section being disposed downstream of said driver stage in said direction of propagation.

4. A traveling wave tube as in claim 3, further comprising a sever section disposed between said driver stage and said gain flattening section for preventing propagation of the electromagnetic signal therebetween.

5. A traveling wave tube as in claim 3, in which said main section further comprises a velocity taper signal interaction section which is disposed downstream of said gain flattening section in said direction of propagation for causing the electromagnetic signal to propagate therethrough with a predetermined third phase velocity which is lower than said first predetermined phase velocity.

6. A traveling wave tube as in claim 5, in which said velocity taper section, said driver stage and said gain flattening section are coupled together to cause interaction between the electron beam and the electromagnetic signal such that said output signal gain of the slow wave structure over said predetermined frequency range is generally constant.

7. A traveling wave tube as in claim 5, further comprising a sever section disposed between said driver stage and said gain flattening section for preventing propagation of the electromagnetic signal therebetween.

8. A traveling wave tube as in claim 3, further comprising a high phase velocity signal interaction section disposed downstream of said gain flattening section in said direction of propagation which causes the electromagnetic signal to propagate therethrough with substantially the first phase velocity.

9. A traveling wave tube as in claim 8, in which said main section further comprises a velocity taper section which is aligned with, coupled together to and disposed downstream of said gain flattening section in said direction of propagation for causing the electromagnetic signal to propagate therethrough with a predetermined third phase velocity which is lower than said first predetermined phase velocity.

10. A traveling wave tube as in claim 9, in which said velocity taper section, said driver stage and said gain flattening section are coupled together to cause interaction between the electron beam and the electromagnetic signal such that said output signal gain of the slow wave structure over said predetermined frequency range is generally constant.

11. In a traveling wave tube, a slow wave structure for causing interaction between an electron beam generated by an electron beam generating means and an electromagnetic signal generated by an electromagnetic signal generating means propagating therethrough and thus providing gain to the electromagnetic signal through said interaction with the electron beam, comprising:

a driver signal interaction stage which causes the electromagnetic signal to propagate therethrough with a predetermined first phase velocity and interact with the electron beam to produce positive signal gain over a predetermined frequency range, and maximum positive signal gain at a predetermined frequency within said predetermined frequency range; and a gain flattening signal interaction section which is disposed downstream of said driver stage in a direction of propagation of the electron beam through the slow wave structure and causes the electromagnetic signal to propagate therethrough with a predetermined second phase velocity which is lower than said first phase velocity to produce a negative signal gain notch region at approximately said predetermined frequency;

said driver and gain flattening sections being coupled together to cause interaction between the electron beam and the electromagnetic signal such that an output signal gain of the slow wave structure over said predetermined frequency range is generally constant.

12. A traveling wave tube as in claim 11, further comprising a high phase velocity signal interaction section disposed downstream of and coupled to said gain flattening section in said direction of propagation which causes the electromagnetic signal to propagate therethrough with substantially the first phase velocity.

13. A traveling wave tube as in claim 11, further comprising a sever section disposed between said driver stage and said gain flattening section for preventing propagation of the electromagnetic signal therebetween.

14. A traveling wave tube as in claim 11, in which the slow wave structure further comprises a velocity taper signal interaction section which is disposed downstream of said gain flattening section in said direction of propagation for causing the electromagnetic signal to propagate therethrough with a predetermined third phase velocity which is lower than said first predetermined phase velocity, said velocity taper section, said driver stage and said gain flattening section being coupled together to cause interaction between the electron beam and the electromagnetic signal such that said output signal gain of the slow wave structure over said predetermined frequency range is generally constant.

15. A traveling wave tube as in claim 14, further comprising a sever section disposed between said driver stage and said gain flattening section for preventing propagation of the electromagnetic signal therebetween.

16. A traveling wave tube as in claim 11, in which said driver stage and said gain flattening section each comprises a plurality of coupled signal interaction cavities which are aligned with each other in said direction of propagation.

17. In a traveling wave tube, a slow wave structure for causing interaction between an electron beam generated by an electron beam generating means and an electromagnetic signal generated by an electromagnetic signal generating means propagating therethrough and thus providing gain to the electromagnetic signal through said interaction with the electron beam, comprising:

a main signal interaction section which causes the electromagnetic signal to propagate therethrough with a predetermined first phase velocity and interact with the electron beam to produce maximum signal gain at a predetermined frequency within a predetermined frequency range; and a gain flattening signal interaction section which is aligned with said main section in a direction of propagation of the electron beam through the slow wave structure and causes the electromagnetic signal to propagate therethrough with a predetermined second phase velocity which is slower than the first phase velocity and interacts with the electron beam to produce a minimum signal gain notch region at approximately said predetermined frequency within said predetermined frequency range;

said main and gain flattening sections being coupled together to cause interaction between the electron beam and the electromagnetic signal such that an output signal gain of the slow wave structure over said predetermined frequency range is generally constant;

said main section comprising a driver signal interaction stage, and an output signal interaction section coupled together and disposed downstream of said driver stage in said direction of propagation, said driver stage including said gain flattening section.

18. A traveling wave tube as in claim 17, in which said gain flattening section is disposed at an upstream end of and coupled to said driver stage in said direction of propagation.

19. A traveling wave tube as in claim 17, in which said gain flattening section is disposed at a downstream end of and coupled to said driver stage in said direction of propagation.

20. A traveling wave tube as in claim 17, in which said driver stage comprises first and second coupled driver signal interaction sections, said gain flattening section being disposed between said first and second driver signal interaction sections in said driver stage.

21. A traveling wave tube as in claim 17, in which said main and gain flattening sections each comprise a plurality of coupled signal interaction cavities which are aligned with each other in said direction of propagation.

22. A traveling wave tube as in claim 21, in which said driver stage comprises:

a plurality of driver signal interaction sections; and a sever section disposed between each two adjacent driver sections respectively for preventing propagation of the electromagnetic signal therebetween.

23. A traveling wave tube as in claim 17, in which said driver stage comprises a plurality of coupled driver signal interaction sections, said gain flattening section being disposed at a downstream end of and coupled to one of said driver sections in said direction of propagation.

24. A traveling wave tube as in claim 17, in which said drive stage comprises a plurality of driver signal interaction sections, said gain flattening section being disposed at an intermediate location in one of said driver sections.

25. A traveling wave tube as in claim 17, in which:

said output section comprises a velocity taper signal interaction section for causing the electromagnetic signal to propagate therethrough with a predetermined third phase velocity which is lower than said first predetermined phase velocity; and said output section, said driver stage and said gain flattening section are coupled together to cause interaction between the electron beam and the electromagnetic signal such that said output signal gain of the slow wave structure over said predetermined frequency range is generally constant.

26. A traveling wave tube as in claim 17, in which said driver stage comprises a plurality of coupled driver signal interaction sections, said gain flattening section being disposed at an upstream end of and coupled to one of said driver sections in said direction of propagation.

27. A traveling wave tube as in claim 17, further comprising a sever section disposed between said driver stage and said output section for preventing propagation of the electromagnetic signal therebetween.

* * * * *